US005480075A

United States Patent [19]

Robinson

[11] Patent Number: 5,480,075

[45] Date of Patent: Jan. 2, 1996

[54] HANGER FOR WESTSUITS AND DIVING ACCESSORIES

[76] Inventor: Clegg G. Robinson, 1423 El Capitan, Napa, Calif. 94558

[21] Appl. No.: 349,330

[22] Filed: Dec. 5, 1994

[51] Int. Cl.[6] ..... A41D 27/22; A47F 5/08

[52] U.S. Cl. ..... 223/88; 223/85; 223/89; 211/115; 211/116; D6/315

[58] Field of Search ..... 223/85, 88, 89, 223/92, 94, DIG. 4; 211/115, 116, 164, 168, 171; 248/324, 340; D6/315, 324

[56] References Cited

U.S. PATENT DOCUMENTS

| | | | |
|---|---|---|---|
| D. 272,503 | 2/1984 | Delucchi | D6/255 |
| 1,467,667 | 12/1923 | Wood | 211/171 |
| 2,706,563 | 4/1955 | Larson | 211/168 |
| 3,856,190 | 12/1974 | Mole et al. | 211/115 |
| 4,366,909 | 1/1983 | Fahmi | 211/116 |
| 4,978,043 | 12/1990 | Uke | 223/88 |
| 5,022,569 | 7/1991 | Beaulieu | 223/85 |
| 5,037,487 | 8/1991 | Santos | 134/22.1 |
| 5,056,693 | 10/1991 | DeBoe | 223/88 |
| 5,163,590 | 11/1992 | Lawler et al. | 223/88 |
| 5,405,065 | 4/1995 | Olson | 223/85 |

FOREIGN PATENT DOCUMENTS

| | | | |
|---|---|---|---|
| 959780 | 4/1950 | France | 223/88 |
| 1122487 | 4/1967 | United Kingdom | 223/85 |

*Primary Examiner*—C. D. Crowder
*Assistant Examiner*—Bibhu Mohanty
*Attorney, Agent, or Firm*—David L. Baker; Henry S. Miller; Rhodes & Ascolillo

[57] ABSTRACT

A wet gear hanger has a vertical support member and a hook support member swivelly connected to an end of the vertical support member. An upper swivel member housing is connected to the vertical support member and an upper swivel member is rotatively inserted in the upper swivel member housing. There is a first upper support member connected to an end of the upper swivel member and a second upper support member connected to another end of the upper swivel member. A first lower swivel member is rotatively inserted in a first lower swivel member housing. There is a second lower swivel member rotatively inserted into a second lower swivel member housing. A third lower swivel member is rotatively inserted into a third lower swivel member housing. A second lower support member is connected to the second lower swivel member. There is an upper support swivel member lock in the upper swivel member. A first lower swivel member lock is located in the first lower swivel member. There is a second lower swivel member lock in the second lower swivel member. A third lower swivel member lock is placed in the third lower swivel member. The first upper support member and second upper support member have a plurality of outwardly extending arms and an angularly upwardly extending tip attached to an end of the outwardly extending arms.

7 Claims, 6 Drawing Sheets

HANGER FOR WESTSUITS AND DIVING ACCESSORIES

BACKGROUND OF THE INVENTION

1. Field of the Invention

This invention relates, generally, to an apparatus for hanging wet sports equipment and, in particular, to a hanger apparatus for hanging wetsuits and scuba diving accessories.

2. Description of the Related Art

There have been many hangers developed to support wetsuits and various pieces of accessory gear such as booties, hoods and gloves while they are drying or being stored or displayed for sale. The weight of wetsuits and their associated gear when wet is destructive to many hangers. Wetsuits must be treated carefully while drying and when stored so as not to crease the Neoprene rubber material. Sharp creases weaken the material and lead to tears and holes. The cost of these items cause the owners and renters of the gear to lean toward caring properly for them. Hangers having narrow supports tend to cause creases in the wetsuit material and often the supports bend out of shape. Breaking or bending allows the wetsuit and accessories to slip off the hanger and onto the ground to become soiled or onto the floor of the closet to lie in a heap forming wrinkles and creases. Most previously developed hangers often break under the weight of water soaked wetgear. This is an expense most aquatic enthusiasts would like to avoid especially on a dive trip.

U.S. Pat. No. Des. 272,503 to C.J. Delucchi on Feb. 07, 1984 for a Hanger for a Diver's Wet Suit shows a hanger having wide gradually curving, hanging surfaces to hold a one or two-piece diving suit. The hanger is generally a hollow plastic single piece member U.S. Pat. No. 4,978,043 to A.K. Uke on Dec. 18, 1990 for a Hanger for Wetsuit Accessories and the Like describes a hook connected to several vertical cross members attached to the hook facing upwards in a comblike manner. There is also a horizontal cross member attached the vertical cross members.

U.S. Pat. No. 5,037,487 to M.J. Santos on Aug. 06, 1991 for a Spray Hanger for Wet Suit describes a hook and a plurality of water pipes having spray nozzles thereon to rinse off a wet suit.

U.S. Pat. No. 5,056,693 to T.S. DeBoe on Oct. 15, 1991 for a Garment Hanger for Wet Suit With Removable Drying Rods shows a lattice work shoulder support to hang a wet suit and with a plurality of angularly extending posts to hang other wet suit gear and an adjustable hook to hang the apparatus.

U.S. Pat. No. 5,163,590 to W.M. Lawler, et al., on Nov. 17, 1992 for a Specialized Aquatic Gear Hanger describes a hanger frame with a detachable swivel hook and a continuous fiat strip frame for hanging aquatic gear thereon.

SUMMARY OF THE INVENTION

The present invention solves the problems encountered by many users of SCUBA and other aquatic sports and commercial wetgear such as wetsuits, regulators and their accessories. The supports are thick and substantially tubular with tips that extend angularly upward. The tips have a bulbular end that aids in wetgear retention on the hanger supports and reduces the chance of creases or stress points that could lead to a hole being punched into the wetsuit material from a sharply pointed hanger end. The support members swivel and releasingly lock in place reducing the chance of breakage if the support members are loaded too heavily. The lock mechanism just releases and allows the support members to release the gear if the gear is too heavy. This alerts the user to lighten the load. In previously developed hangers sometime after the gear is hung on the hanger and the user has left, the weight of the gear would break the support members and the user would find his or her gear in a gear damaging or non-drying heap on the ground, floor, tub or shower.

In one aspect of the present invention, a wet gear hanger is described that has a vertical support member and a hook support member connected to an end of the vertical support member. An upper swivel member housing is connected to the vertical support member. An upper swivel member is rotatively inserted in the upper swivel member housing and a first upper support member connected to an end of the upper swivel member. A second upper support member is connected to another end of the upper swivel member. An upper support swivel member lock is in the upper swivel member and is springingly biased into the upper swivel member housing.

There is a first lower swivel member housing connected to another end of the vertical support member. A first lower swivel member is rotatively inserted in the first lower swivel member housing. There is a first lower support member housing connected to an end of the first lower swivel member and a second lower swivel member housing is attached to the first lower support member housing. A second lower swivel member is rotatively inserted into the second lower swivel member housing and a first lower support member is connected to the second lower swivel member. There is a second lower support member housing connected to another end of the first lower swivel member. A third lower swivel member housing is attached to the second lower support member housing. There is a third lower swivel member rotatively inserted into the third lower swivel member housing and a second lower support member is connected to the second lower swivel member. A lower swivel member lock is in the lower swivel member and is springingly biased into the first lower swivel member housing.

In a second aspect of the present invention, a wet gear hanger is described that has a vertical support member. There is a hook support member swivelly connected to an end of the vertical support member and a upper swivel member housing connected to the vertical support member. An upper swivel member is rotatively inserted in the upper swivel member housing and a first upper support member is connected to an end of the upper swivel member. There is also a second upper support member connected to another end of the upper swivel member. An upper support swivel member lock is in the upper swivel member and the upper support swivel member lock is also springingly biased into the upper swivel member housing.

A first lower swivel member housing is connected to another end of the vertical support member. A first lower swivel member is rotatively inserted in the first lower swivel member housing and there is a first lower support member housing connected to an end of the first lower swivel member. A second lower swivel member housing is attached to the first lower support member housing and a second lower swivel member is rotatively inserted into the second lower swivel member housing. There is a first lower support member connected to the second lower swivel member. There is a second lower support member housing connected to another end of the first lower swivel member. A third lower swivel member housing is attached to the second lower support member housing and a third lower swivel member is rotatively inserted into the third lower swivel member housing. A second lower support member is connected to the second lower swivel member.

A first lower swivel member lock is in the first lower swivel member and is springingly biased into the first lower swivel member housing. There is a second lower swivel member lock in the second lower swivel member and the second lower swivel member lock is springingly biased into the second lower swivel member housing.

It is an object of this invention to provide a hanger (for wetsuits, diving accessories and other sports gear) that can be easily stored when not in use and that has supports that may be locked in place and that will release, to reduce breakage, from the locked position if loaded too heavily.

DESCRIPTION OF THE PREFERRED EMBODIMENT

Figure 1:
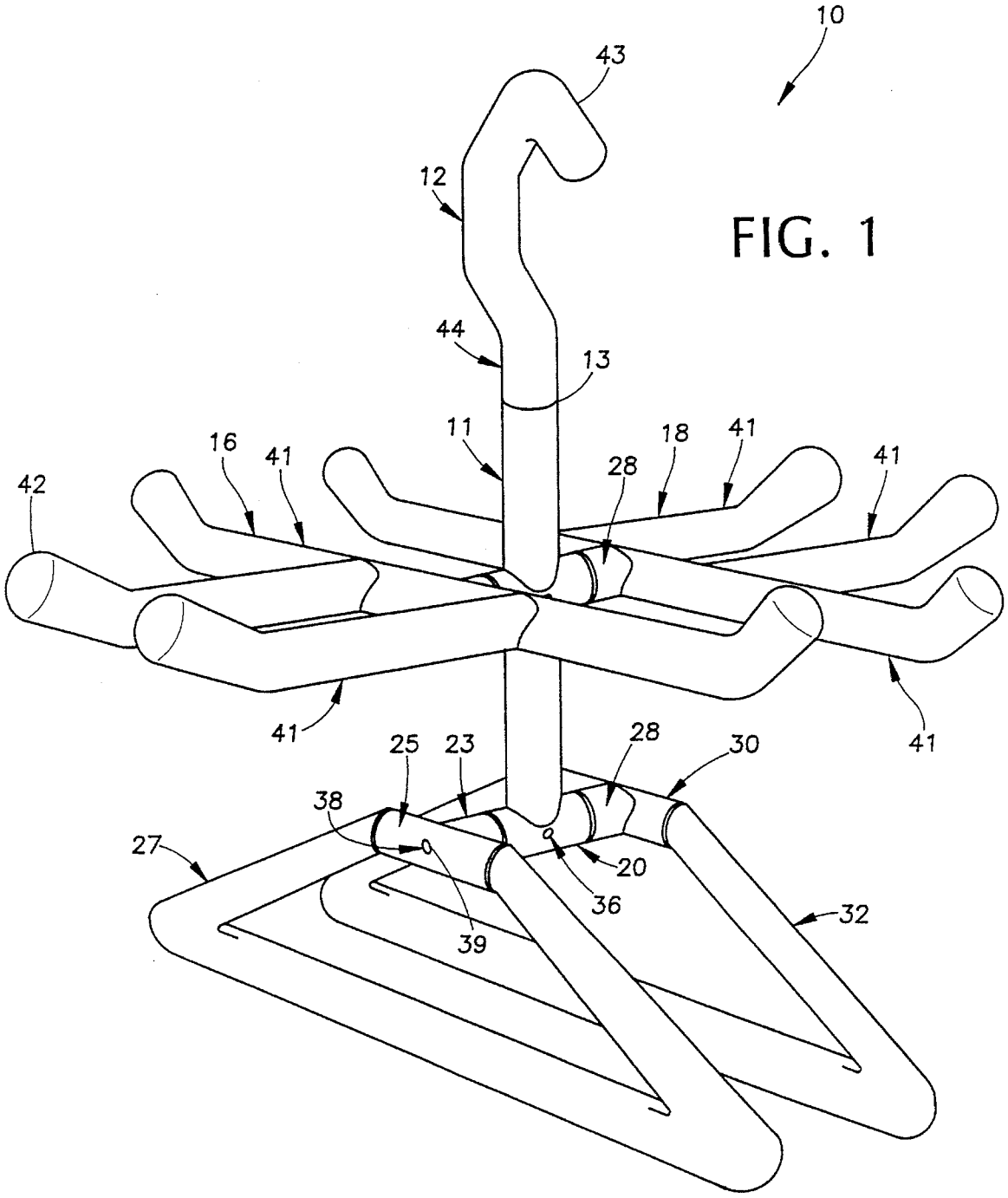
FIG. 1 is a perspective view of the Hanger for Wetsuits and Diving Accessories in a support position showing the accessory arms extended.
Figure 2:
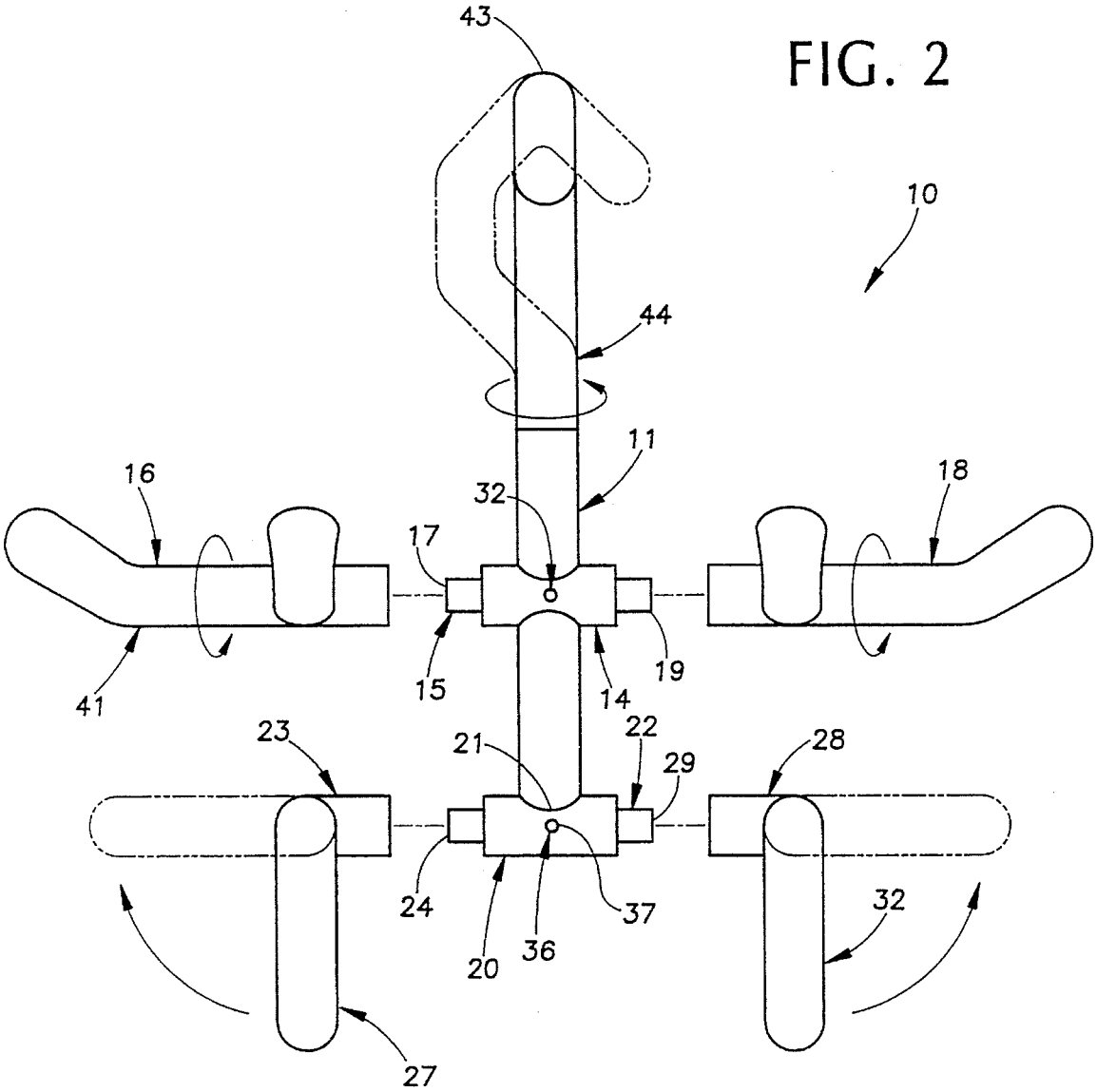
FIG. 2 is an exploded front elevational view showing the direction the hook, the upper support members and the lower support members swivel.
Figure 3:
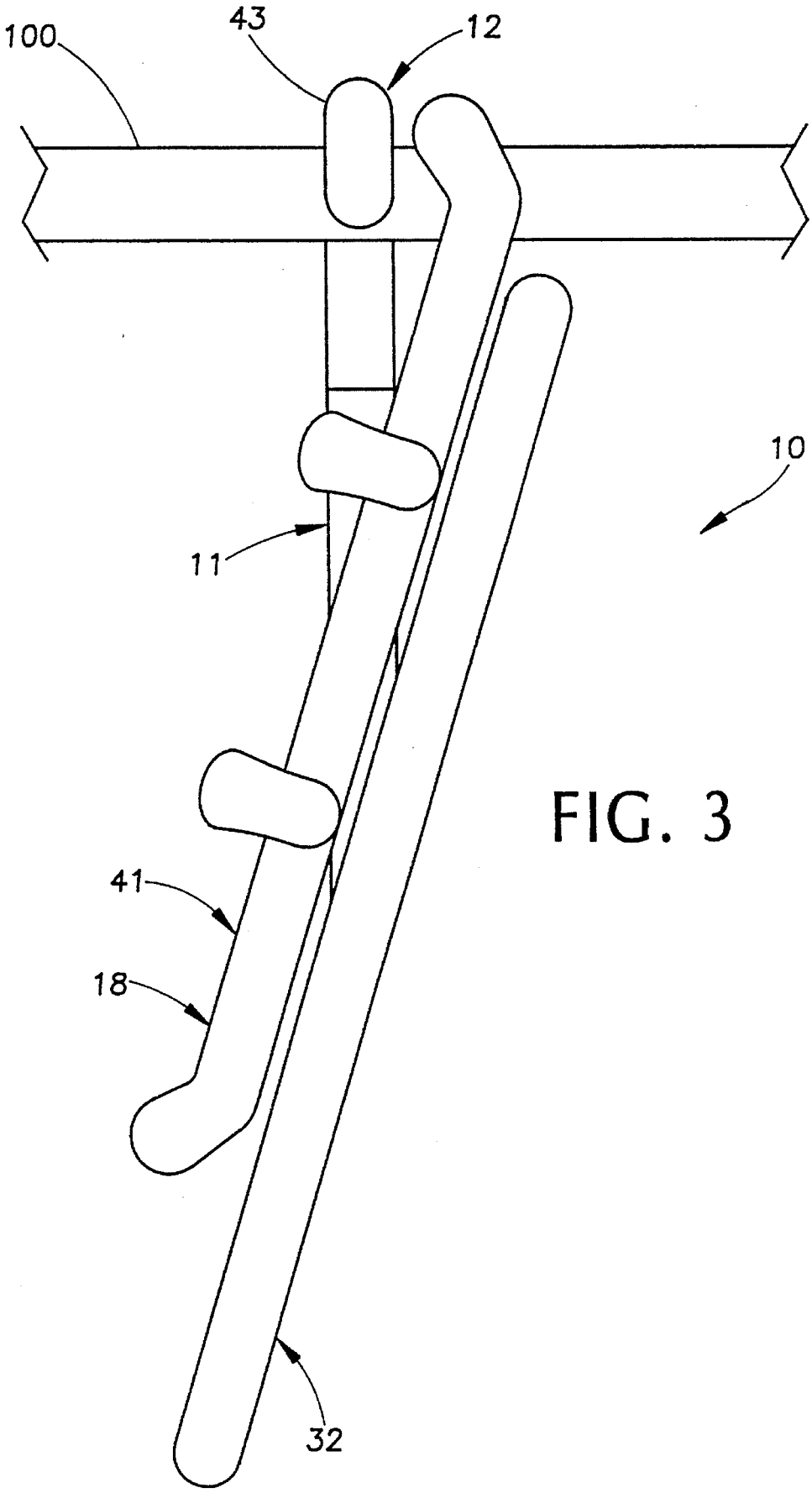
FIG. 3 is a front elevational view of the hanger in a storage position with the upper and lower support members folded.
Figure 4:
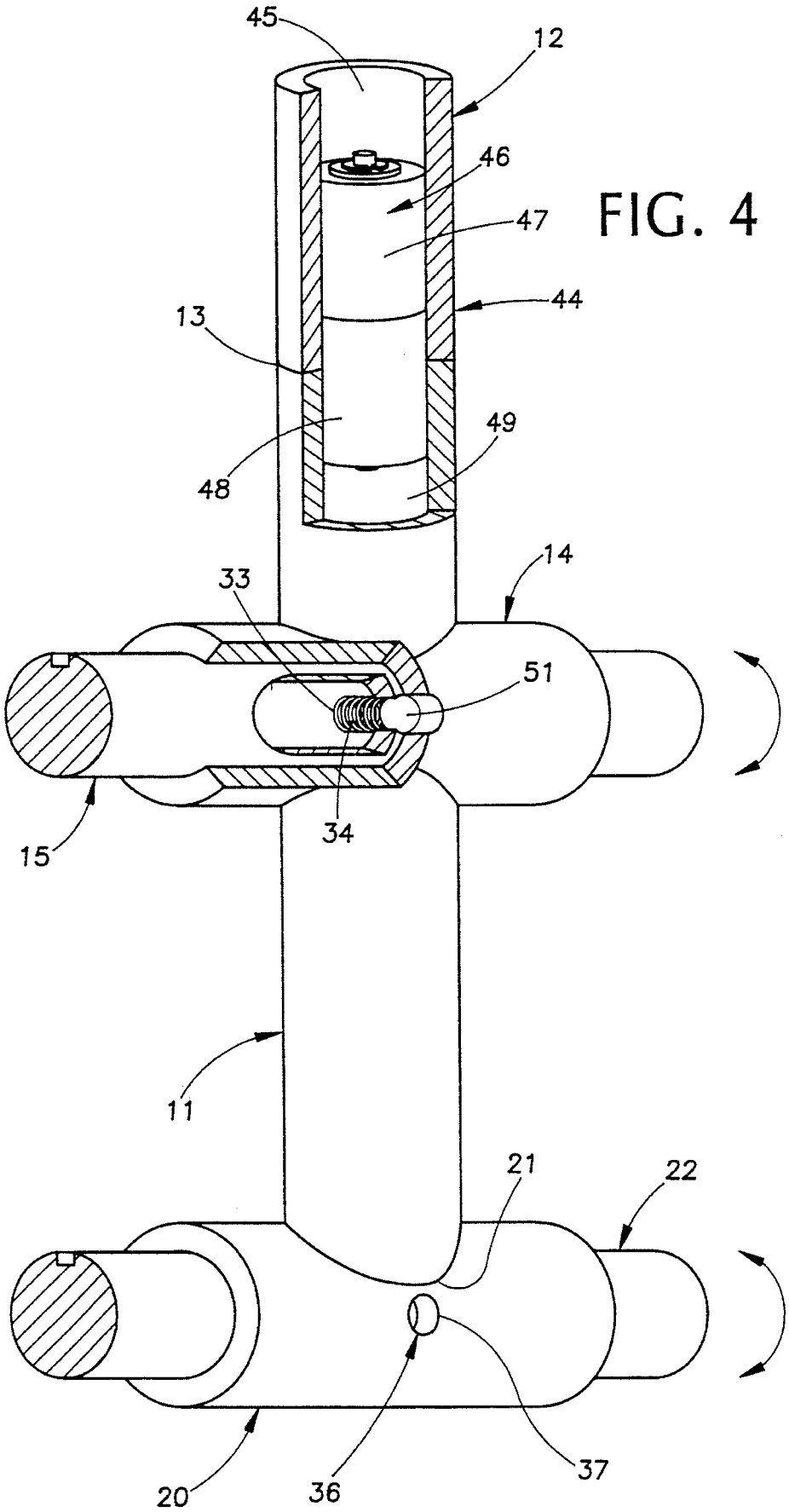
FIG. 4 is a partial, cut-away, perspective view showing the swivel members and locking apparatus.
Figure 5:
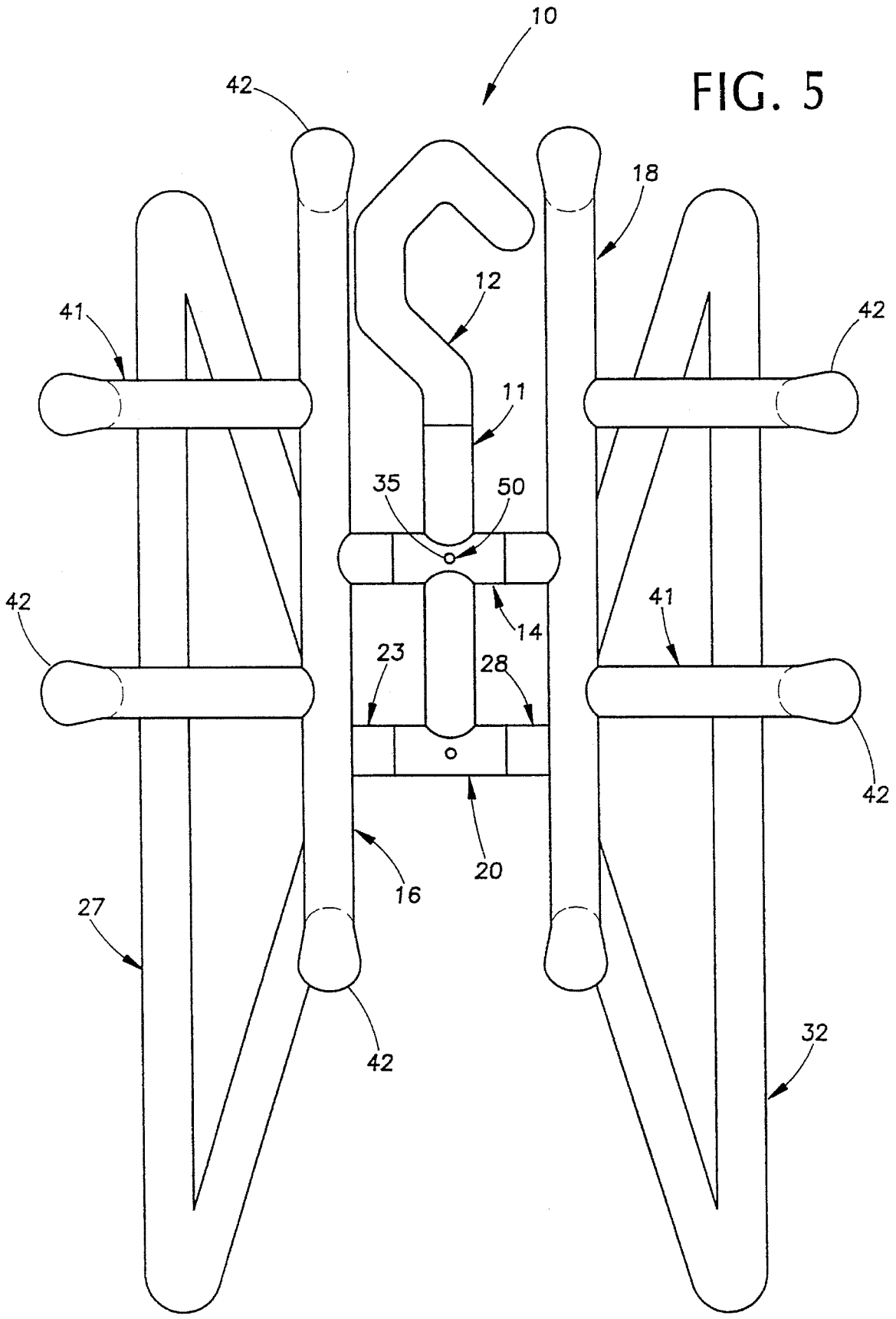
FIG. 5 is a top plan view showing the hook folded down toward the lower support members.
Figure 6:
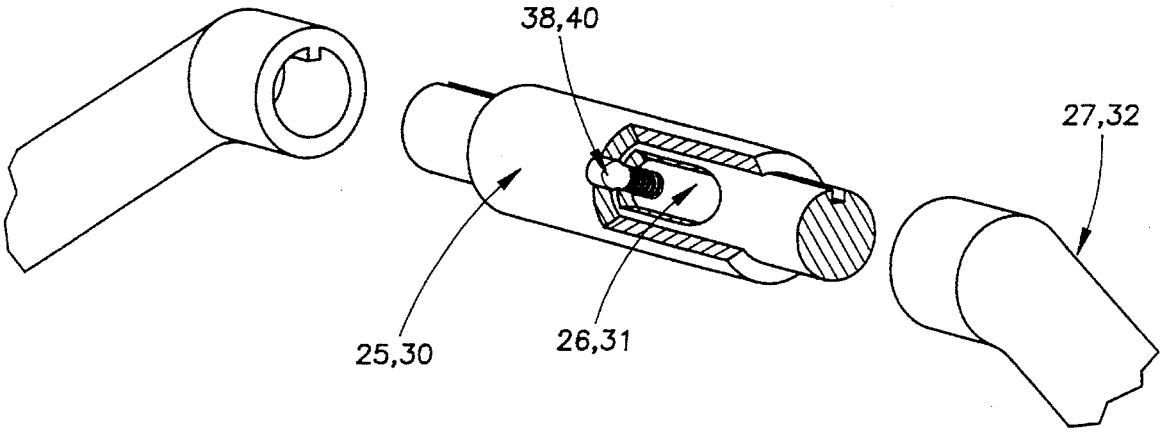
FIG. 6 is a partial, exploded view of the second and third lower swivel member housings and second a third swivel members shown with their respective numbers.

Referring to FIGS. 1 through 6, a wet gear hanger 10 preferably molded of suitable plastics and by known methods is shown and described that has a vertical support member 11 and a hook support member 12 swivelly connected to an end 13 of the vertical support member 11. An upper swivel member housing 14 is connected to the vertical support member 11 and an upper swivel member 15 is rotatively inserted in the upper swivel member housing 14. There is a first upper support member 16 adhered by suitable adhesives to an end 17 of the upper swivel member 15 and a second upper support member 18 is adhered by suitable adhesives to another end 19 of the upper swivel member 15.

A first lower swivel member housing 20 is connected to another end 21 of the vertical support member 11 and a first lower swivel member 22 is rotatively inserted in the first lower swivel member housing 20. A first lower support member housing 23 is connected to an end 24 of the first lower swivel member 22 and a second lower swivel member housing 25 is attached to the first lower support member housing 23. There is a second lower swivel member 26 (see FIG. 6) rotatively inserted into the second lower swivel member housing 25. A first lower support member 27 is adhered by suitable adhesives to the second lower swivel member 26 and a second lower support member housing 28 connected to another end 29 of the first lower swivel member 20. There is a third lower swivel member housing 30 (see FIG. 6) attached to the second lower support member housing 28. A third lower swivel member 31 is rotatively inserted into the third lower swivel member housing 30. A second lower support member 32 is adhered to by suitable adhesives to the third lower swivel member 31. The upper and lower swivel members have a key slot into which is inserted a key, integral to the upper and lower support members (see FIGS. 4 and 6). The keys in the key slots reduce the chance of rotative slippage of the support members on the swivel members when weight is placed on the support members.

There is an upper support swivel member lock 50 in a passageway 33 in the upper swivel member 15. The locks include a spring 34 having a ball member 51 (usually a ball bearing, see FIG. 4) on at least one end of the spring. The upper support swivel member lock 50 is also springingly (see spring 34) biased into a port 35 in the upper swivel member housing 14. A first lower swivel member lock 36 is located in a passageway (not shown) in the first lower swivel member 22 and is also springingly biased into a port 37 of the first lower swivel member housing 20. There is a second lower swivel member lock 38 in a passageway (not shown) in the second lower swivel member 26. The second lower swivel member lock 38 is also springingly biased into a port 39 in the second lower swivel member housing 25. A third lower swivel member lock 40 is placed in a passageway in the third lower swivel member 31 and is springingly biased into a port (not shown) in the third lower swivel member housing 30.

The ball member is preferably not quite half way into the ports in the swivel member housings. If too much weight is placed on the support members, the ball is pushed out of the port, back into the swivel members and the support members are allowed to fold. This also allows the user to push inward slightly on the ball to fold the support members into the storage or transportation position shown in FIG. 3. When the support members are pulled up into their proper support position shown in FIG. 1, the balls slip into the ports biased to that position by the springs and the support members are once again locked in place.

The first upper support member 16 and second upper support member 18 have a plurality of outwardly extending arms 41 and an angularly upwardly extending tip 42 attached to an end of the outwardly extending arms 41. The first lower support member 27 and the second lower support member 32 are substantially triangular in shape. The hook support member 12 has a hook 43 to hang on a suitable object 100 such as a rod, line or other suitable secured support. There is a hook shaft 44 attached to the hook 43. The hook shaft has a channel 45 therein to receive the swivel block assembly 46. There is an upper swivel block 47 adhered by suitable adhesives to the hook shaft 44 (to the inner wall of the channel 45). A lower swivel block 48 is rotatively fastened to the upper swivel block 47. There is another channel 49 inside the vertical support member 11 and the lower swivel block 48 is adhered by suitable adhesives to the vertical support member 11 (to the inner wall of the other channel 49).

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A wet gear hanger comprising:

(a) a vertical support member;

(b) a hook support member connected to an end of the vertical support member;

(c) an upper swivel member housing connected to the vertical support member;

(d) an upper swivel member rotatively inserted in the upper swivel member housing;

(e) a first upper support member connected to an end of the upper swivel member;

(f) a second upper support member connected to another end of the upper swivel member;

(g) a first lower swivel member housing connected to another end of the vertical support member;

(h) a first lower swivel member rotatively inserted in the first lower swivel member housing;

(i) a first lower support member housing connected to an end of the first lower swivel member;

(j) a second lower swivel member housing attached to the first lower support member housing;

(k) a second lower swivel member rotatively inserted into the second lower swivel member housing;

(l) a first lower support member connected to the second lower swivel member;

(m) a second lower support member housing connected to another end of the first lower swivel member;

(n) a third lower swivel member housing attached to the second lower support member housing;

(o) a third lower swivel member rotatively inserted into the third lower swivel member housing;

(p) a second lower support member connected to the third lower swivel member; and (q) an upper support swivel member lock in the upper swivel member and springingly biased into the upper swivel member housing.

2. A wet gear hanger as described in claim 1 further comprising a lower swivel member lock in the lower swivel member and springingly biased into the first lower swivel member housing.

3. A wet gear hanger comprising:

(a) a vertical support member;

(b) a hook support member swivelly connected to an end of the vertical support member;

(c) an upper swivel member housing connected to the vertical support member;

(d) an upper swivel member rotatively inserted in the upper swivel member housing;

(e) a first upper support member connected to an end of the upper swivel member;

(f) a second upper support member connected to another end of the upper swivel member;

(g) a first lower swivel member housing connected to another end of the vertical support member;

(h) a first lower swivel member rotatively inserted in the first lower swivel member housing;

(i) a first lower support member housing connected to an end of the first lower swivel member;

(j) a second lower swivel member housing attached to the first lower support member housing;

(k) a second lower swivel member rotatively inserted into the second lower swivel member housing;

(l) a first lower support member connected to the second lower swivel member;

(m) a second lower support member housing connected to another end of the first lower swivel member;

(n) a third lower swivel member housing attached to the second lower support member housing;

(o) a third lower swivel member rotatively inserted into the third lower swivel member housing;

(p) a second lower support member connected to the third lower swivel member;

(q) an upper support swivel member lock in the upper swivel member and springingly biased into the upper swivel member housing;

(r) a first lower swivel member lock in the first lower swivel member and springingly biased into the first lower swivel member housing; and (s) a second lower swivel member lock in the second lower swivel member and springingly biased into the second lower swivel member housing.

4. A wet gear hanger comprising:

(a) a vertical support member;

(b) a hook support member swivelly connected to an end of the vertical support member;

(c) an upper swivel member housing connected to the vertical support member;

(d) an upper swivel member rotatively inserted in the upper swivel member housing;

(e) a first upper support member connected to an end of the upper swivel member;

(f) a second upper support member connected to another end of the upper swivel member;

(g) a first lower swivel member housing connected to another end of the vertical support member;

(h) a first lower swivel member rotatively inserted in the first lower swivel member housing;

(i) a first lower support member housing connected to an end of the first lower swivel member;

(j) a second lower swivel member housing attached to the first lower support member housing;

(k) a second lower swivel member rotatively inserted into the second lower swivel member housing;

(l) a first lower support member connected to the second lower swivel member;

(m) a second lower support member housing connected to another end of the first lower swivel member;

(n) a third lower swivel member housing attached to the second lower support member housing;

(o) a third lower swivel member rotatively inserted into the third lower swivel member housing;

(p) a second lower support member connected to the third lower swivel member;

(q) an upper support swivel member lock in the upper swivel member and springingly biased into the upper swivel member housing;

(r) a first lower swivel member lock in the first lower swivel member and springingly biased into the first lower swivel member housing;

(s) a second lower swivel member lock in the second lower swivel member and springingly biased into the second lower swivel member housing; and (t) a third lower swivel member lock in the third lower swivel member and springingly biased into the third lower swivel member housing.

5. A wet gear hanger as described in claim 4 wherein the first upper support member and second upper support member comprise:

(a) a plurality of outwardly extending arms; and (b) an angularly upwardly extending tip attached to an end of the outwardly extending arms.

6. A wet gear hanger as described in claim 4 wherein the first lower support member and the second lower support member comprise being substantially triangular in shape.

7. A wet gear hanger as described in claim 4 wherein the hook support member further comprises:

(a) a hook;

(b) a hook shaft attached to the hook;

(c) an upper swivel block adhered to the hook shaft;

(d) a lower swivel block rotatively fastened to the upper swivel block; and (e) the lower swivel block adhered to the vertical support housing.

* * * * *